US011421697B2

(12) United States Patent
Fan et al.

(10) Patent No.: US 11,421,697 B2
(45) Date of Patent: Aug. 23, 2022

(54) FAN WITH LIGHT SOURCE

(71) Applicant: COOLER MASTER TECHNOLOGY INC., New Taipei (TW)

(72) Inventors: Shao Dong Fan, Hui Zhou (CN); Zubin Xie, Hui Zhou (CN)

(73) Assignee: COOLER MASTER TECHNOLOGY INC., New Taipei (TW)

( * ) Notice: Subject to any disclaimer, the term of this patent is extended or adjusted under 35 U.S.C. 154(b) by 0 days.

(21) Appl. No.: 17/197,491

(22) Filed: Mar. 10, 2021

(65) Prior Publication Data

US 2022/0049706 A1 Feb. 17, 2022

(30) Foreign Application Priority Data

Aug. 13, 2020 (CN) ..... 202010812029.5
Aug. 13, 2020 (CN) ..... 202021682819.8

(51) Int. Cl.

| | |
|---|---|
| ***F04D 25/08*** | (2006.01) |
| ***F04D 29/00*** | (2006.01) |
| ***F21V 33/00*** | (2006.01) |
| *F04D 29/02* | (2006.01) |

(52) U.S. Cl.

CPC ..... *F04D 25/08* (2013.01); *F04D 29/002* (2013.01); *F04D 29/005* (2013.01); *F21V 33/0096* (2013.01); *F04D 29/023* (2013.01)

(58) Field of Classification Search

CPC ..... F04D 25/08; F04D 29/002; F04D 29/005; F21V 33/0096

See application file for complete search history.

(56) References Cited

U.S. PATENT DOCUMENTS

| | | | | |
|---|---|---|---|---|
| 10,900,493 | B2 * | 1/2021 | Huang | F04D 29/005 |
| 10,927,842 | B2 * | 2/2021 | Lin | F04D 29/646 |
| 2018/0066838 | A1 * | 3/2018 | Huang | F21V 33/0096 |
| 2018/0163960 | A1 * | 6/2018 | Lin | F04D 29/005 |
| 2021/0199128 | A1 * | 7/2021 | Xu | F04D 29/601 |

* cited by examiner

*Primary Examiner* — Ninh H. Nguyen
(74) *Attorney, Agent, or Firm* — Maschoff Brennan

(57) ABSTRACT

A fan including fan frame, fan rotor, at least one light source and first light guide component. Fan frame includes frame body and first assembling structures. Frame body includes outer and inner walls. First assembling structures each comprise extending base and post. Extending base protrudes from outer wall, a part of extending base is spaced apart from outer wall so that a gap is formed therebetween, and post protrudes from a side of extending base located away from outer wall. Light source is disposed on fan frame. First light guide component is engaged with fan frame. A light emitted from light source is configured to be incident on first light guide component. First light guide component includes first wall and second assembling structures. Second assembling structures are connected to first wall and respectively and removably mounted on first assembling structures.

16 Claims, 5 Drawing Sheets

FAN WITH LIGHT SOURCE

CROSS-REFERENCE TO RELATED APPLICATIONS

This non-provisional application claims priority under 35 U.S.C. § 119(a) on Patent Application No(s). 202010812029.5 filed in China, on Aug. 13, 2020, and on Patent Application No(s). 202021682819.8 filed in China, on Aug. 13, 2020, the entire contents of which are hereby incorporated by reference.

TECHNICAL FIELD

The disclosure relates to a fan, more particularly to a fan with at least one light source.

BACKGROUND

With development of the widespread personal computer and the information technology, the personal computer not only assist a user to deal with his/her business, but also is commonly used as a multimedia player and an entertainment equipment by cooperating with a variety of peripherals and a video output device having high resolution.

Currently, some of the casing or chassis of the personal computer has been made of transparent materials (e.g., acrylic) or been designed to be hollow, and a multicolored or full-color light emitting diode is disposed in the personal computer. With such configuration, the personal computer can have an attractive and multicolored appearance.

In some conventional personal computers, the multicolored or full-color light emitting diode is disposed on the fan to generate dynamic and multicolored visual effect. In the prior art, the light emitting diode is disposed on a fan frame or a rib of the fan frame and emits light toward the fan blades, thereby allowing the fan to generate visual effect.

In general, a light guide ring is fixed on the fan frame using screwing manner. However, there should be a screw hole on the fan frame for the screwed to be screwed therein, which affects the appearance of the fan frame and may cause a light leakage.

SUMMARY

The disclosure provides a fan with light source including a frame body without any screw hole, thereby maintaining the appearance of the fan body, preventing the light leakage from occurring, and maintaining the convenience of the assembling.

One embodiment of this disclosure provides a fan including a fan frame, a fan rotor, at least one light source and a first light guide component. The fan frame includes a frame body and a plurality of first assembling structures. The frame body includes an outer wall and an inner wall. The outer wall surrounds the inner wall. The inner wall forms an accommodation space. The plurality of first assembling structures each comprise an extending base and a post. In each of the plurality of first assembling structures, the extending base protrudes from the outer wall of the frame body, a part of the extending base is spaced apart from the outer wall of the frame body so that a gap is formed between the part of the extending base and the outer wall of the frame body, and the post protrudes from a side of the extending base that is located away from the outer wall of the frame body. The fan rotor is located in the accommodation space and rotatably disposed on the fan frame. The at least one light source is disposed on the fan frame. The first light guide component is engaged with the fan frame. A light emitted from the at least one light source is configured to be incident on the first light guide component. The first light guide component includes a first wall and a plurality of second assembling structures. The plurality of second assembling structures are connected to the first wall and are respectively and removably mounted on the plurality of first assembling structures.

Another embodiment of this disclosure provides a fan including a fan frame, a fan rotor, at least one light source and a first light guide component. The fan frame has an accommodation space. The fan rotor is located in the accommodation space and is rotatably disposed on the fan frame. The at least one light source is disposed on the fan frame. The first light guide component is mounted on the fan frame via a plurality of posts and a plurality of first mounting holes that respectively mate with each other. A light emitted from the at least one light source is configured to be incident on the first light guide component. The fan rotor is rotatable about an axis relative to the fan frame. Extending directions of the plurality of posts are non-parallel to the axis.

According to the fan with light source disclosed by the above embodiments, since the first light guide component and the second light guide component both are mounted on the fan frame via the posts of the first assembling structures, the fan frame can omit the screw hole for the fixation of any light guide component on the fan frame. Therefore, the appearance of the fan frame can be maintained the light leakage can be prevented from occurring and the convenience of the assembling can be maintained.

In addition, the extending directions of the posts are non-parallel or perpendicular to the axis of the fan, such that the appearance of the fan frame is further maintained, the light leakage is further prevented from occurring, and the convenience of the assembling is further maintained.

BRIEF DESCRIPTION OF THE DRAWINGS

The present disclosure will become better understood from the detailed description given herein below and the accompanying drawings which are given by way of illustration only and thus are not intending to limit the present disclosure and wherein.

DETAILED DESCRIPTION

Figure 1:
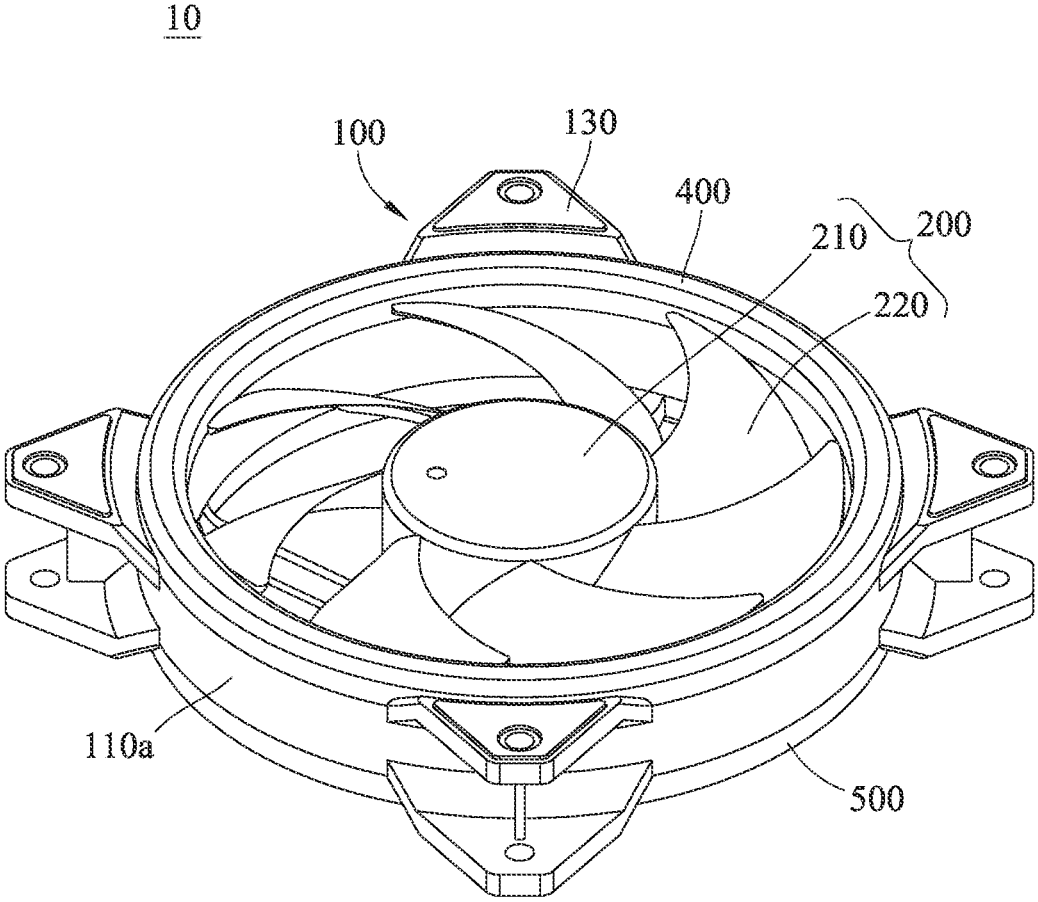
FIG. 1 is a perspective view of a fan according to one embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
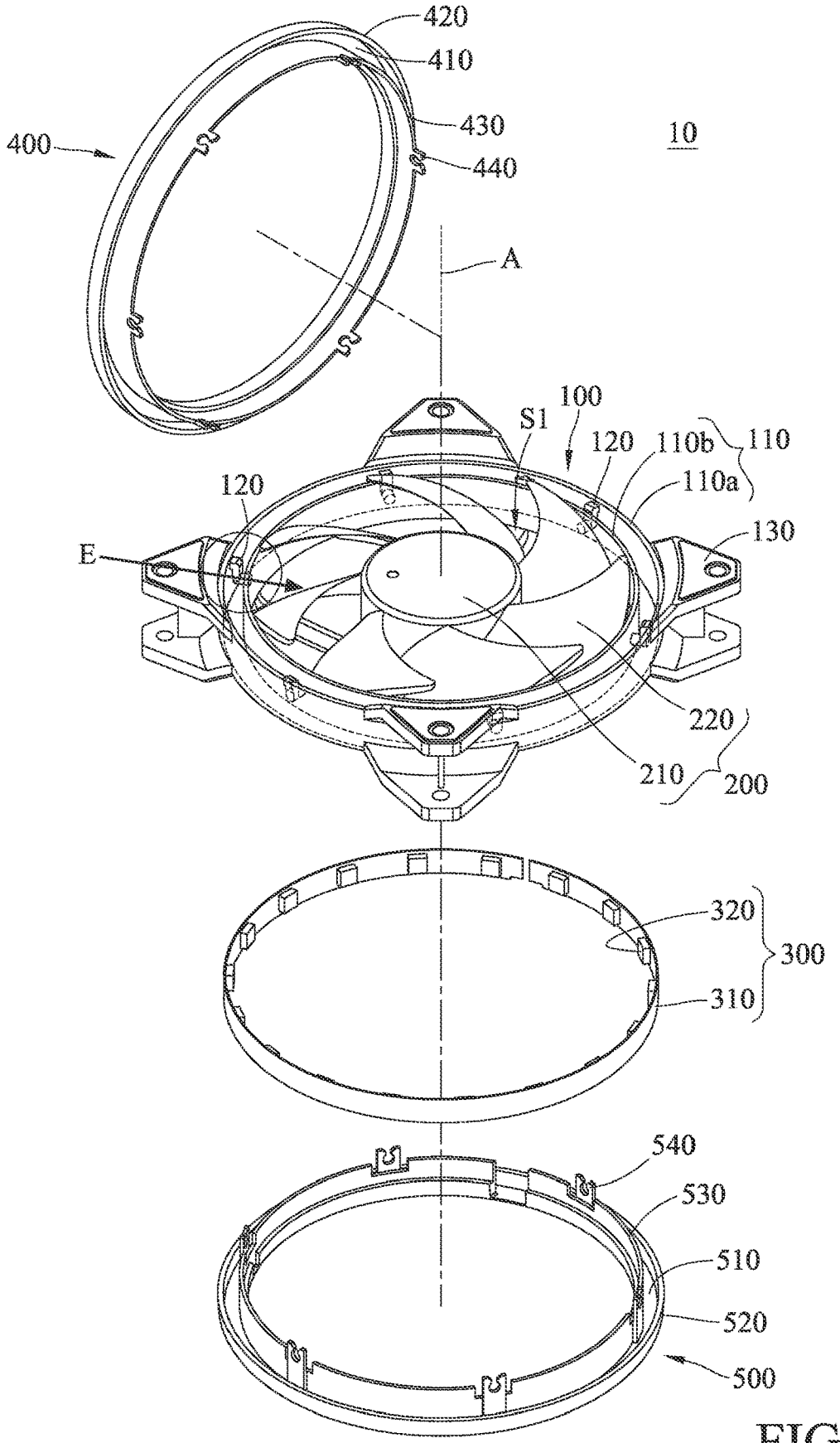
FIG. 2 is an exploded view of the fan in FIG. 1.
Figure 3:
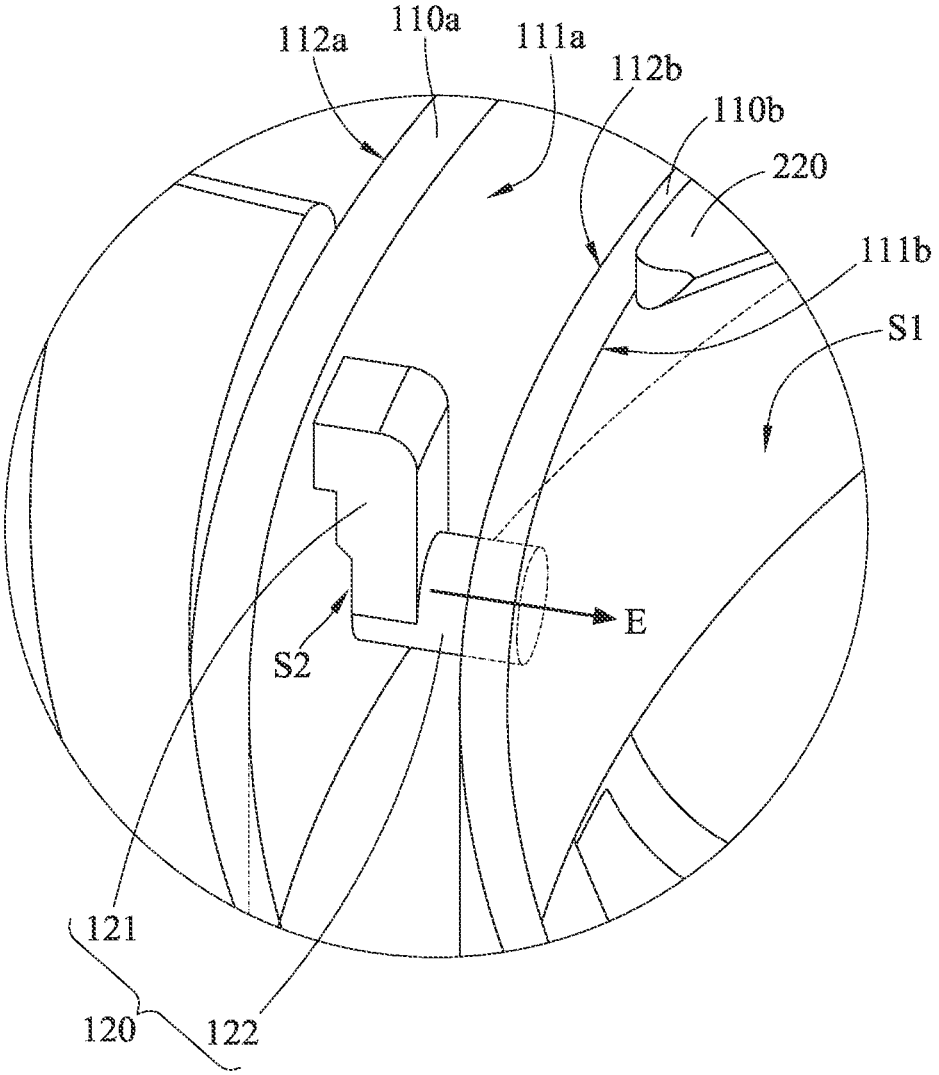
FIG. 3 is a partially enlarged view of the fan in FIG. 2.

Please refer to FIGS. 1 to 3, where FIG. 1 is a perspective view of a fan according to one embodiment of the disclosure, FIG. 2 is an exploded view of the fan in FIG. 1, and FIG. 3 is a partially enlarged view of the fan in FIG. 2.

This embodiment provides a fan 10 that is, for example, an axial fan. The fan 10 includes a fan frame 100, a fan rotor 200, a light source 300 and a first light guide component 400. In addition, the fan 10 may further include a second light guide component 500.

The fan frame 100 includes a frame body 110 and a plurality of first assembling structures 120. The frame body 110 includes an outer wall 110*a* and an inner wall 110*b*. The outer wall 110*a* and the inner wall 110*b* are, for example, in a ring shape, concentric and spaced apart from each other. That is, the outer wall 110*a* surrounds the inner wall 110*b*, and the outer wall 110*a* and the inner wall 110*b* are two concentric rings spaced apart from each other. The outer wall 110*a* has an inner surface 111*a* and an outer surface 112*a*. The outer surface 112*a* faces away from the inner surface 111*a*. The inner wall 110*b* has an inner surface 111*b* and an outer surface 112*b*. The inner surface 111*b* of the inner wall 110*b* forms an accommodation space S1. The outer surface 112*b* of the inner wall 110*b* faces away from the inner surface 111*b* and faces toward the inner surface 111*a* of the outer wall 110*a*.

The first assembling structures 120 protrude from the inner surface 111*a* of the outer wall 110*a* of the frame body 110. In detail, each first assembling structure 120 includes an extending base 121 and a post 122. A part of the extending base 121 is spaced apart from the inner surface 111*a* of the outer wall 110*a* of the frame body 110 so that a gap S2 is formed therebetween. The post 122 protrudes from a side of the extending base 121 that is located away from the outer wall 110*a* of the frame body 110, and is connected to the outer surface 112*b* of the inner wall 110*b*. That is, the outer wall 110*a* is fixed to the inner wall 110*b* via the first assembling structures 120.

In this embodiment, the outer wall 110*a* is fixed to the inner wall 110*b* only via the first assembling structures 120, but the disclosure is not limited thereto. In other embodiments, besides the first assembling structures, the outer wall 110*a* may be fixed to the inner wall 110*b* via other extending structures. In addition, in other embodiments where the outer wall is fixed to the inner wall via other extending structures, the first assembling structures may only be connected to the inner surface 111*a* of the outer wall 110*a* or the outer surface 112*b* of the inner wall 110*b*.

The fan frame 100 may further include a plurality of protrusions 130. The protrusions 130 radially protrude outward from the outer surface 112*a* of the outer wall 110*a* of the frame body 110. Each of the protrusions 130, for example, has a through hole for the penetration of a screw so that the screw can fix the protrusions 130 on a motherboard, a chassis or another component.

The fan rotor 200 is located in the accommodation space S1 and includes a hub 210 and a plurality of blades 220. The hub 210 is rotatably disposed on the fan frame 100. The blades 220 radially protrude from an outer surface of the hub 210.

The light source 300 is disposed on the fan frame 100 and includes a circuit board 310 and a plurality of light emitting components 320. The circuit board 310 is located in the gap S2 and is fixed between the extending base 121 and the inner surface 111*a* of the outer wall 110*a* of the frame body 110. The light emitting components 320 are disposed on a side of the circuit board 310 that is located away from the outer wall 110*a* of the frame body 110 of the fan frame 100.

In this embodiment, there is one light source 300, but the disclosure is not limited thereto. In other embodiments, there may be a plurality of light sources.

Figure 4:
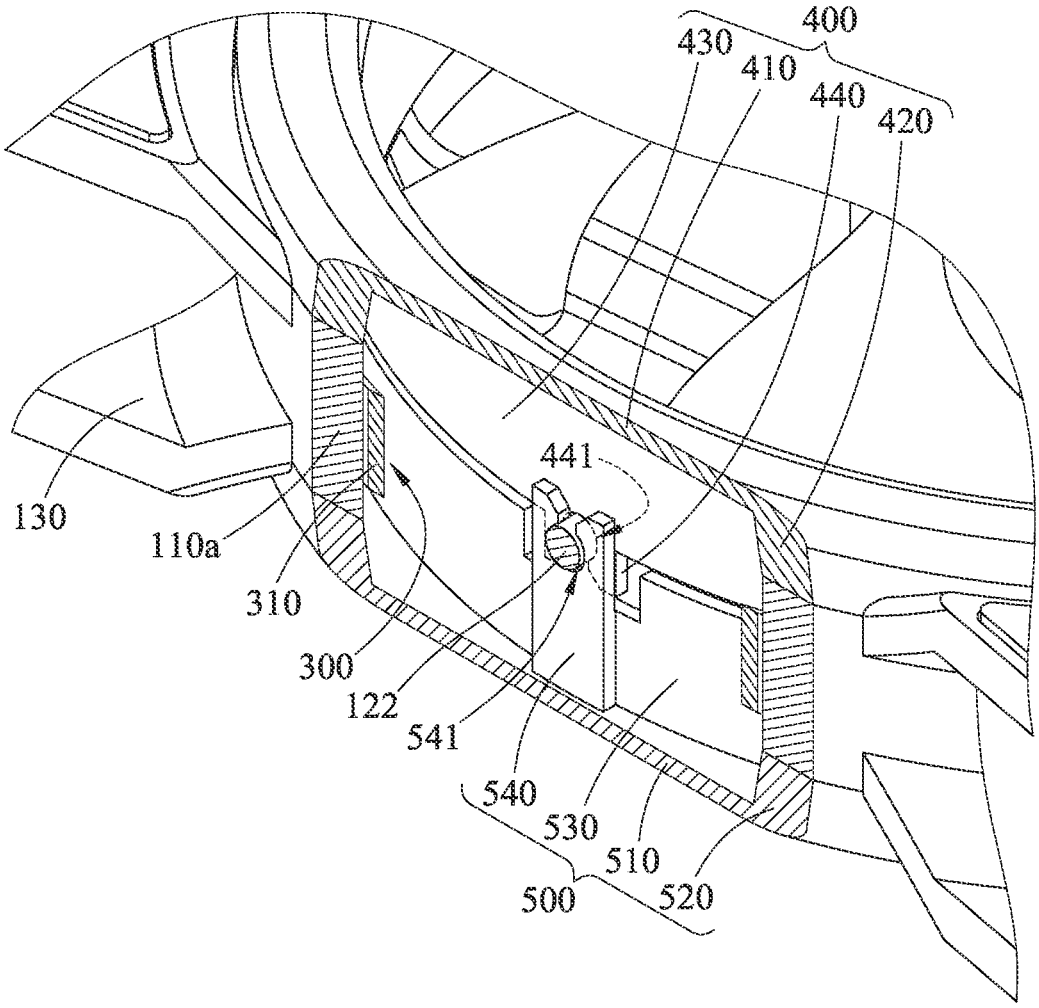
FIG. 4 is a partially enlarged perspective and cross-sectional view of the fan in FIG. 1.
Figure 5:
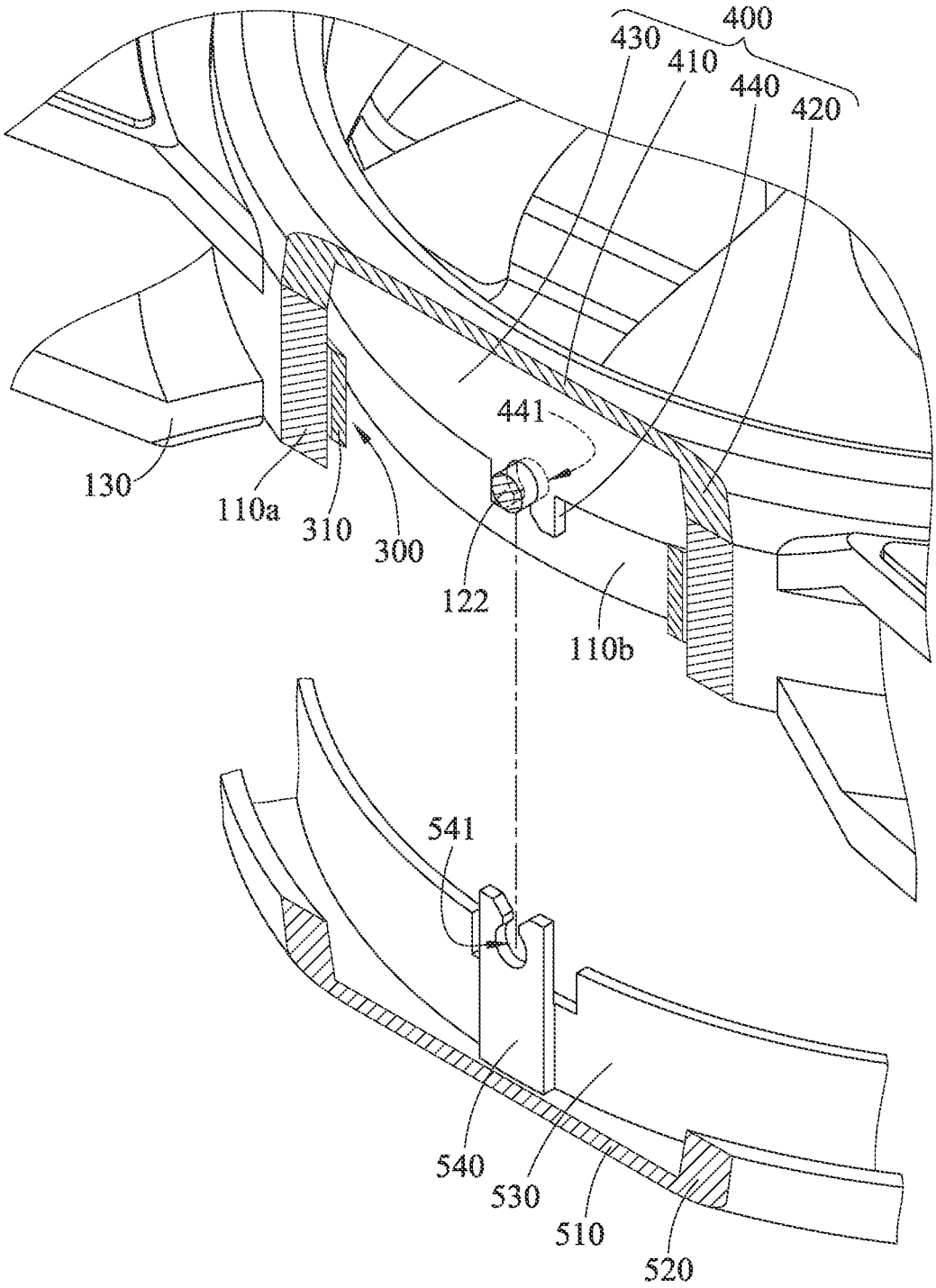
FIG. 5 is a partially exploded view of the fan in FIG. 4.

Please additionally refer to FIGS. 4 and 5, where FIG. 4 is a partially enlarged and perspective cross-sectional view of the fan in FIG. 1, and FIG. 5 is a partially exploded view of the fan in FIG. 4.

The first light guide component 400 is engaged with the fan frame 100, and the light emitted from the light source 300 is configured to be incident on the first light guide component 400. In this embodiment, the first light guide component 400 includes a first wall 410 and a plurality of second assembling structures 440. In addition, the first light guide component 400 may further include a second wall 420 and a third wall 430. The second wall 420 and the third wall 430 are respectively connected to two opposite sides of the first wall 410, and the second wall 420 surrounds the third wall 430. The second wall 420 rests on the outer wall 110*a* of the frame body 110 of the fan frame 100 and is located on a side of the light source 300.

The second assembling structures 440 are connected to the first wall 410 via the third wall 430. Each second assembling structure 440 has a mounting hole 441. The posts 122 of the first assembling structures 120 are respectively inserted into the mounting holes 441 of the second assembling structures 440, such that the first assembling structures 120 are removably mounted on the second assembling structures 440.

In this embodiment, the second assembling structures 440 are connected to the first wall 410 via the third wall 430, but the disclosure is not limited thereto. In other embodiments, the second assembling structures may be located between the second wall 420 and the third wall 430.

In this embodiment, the fan rotor 200 is rotatable about an axis A relative to the frame body 110, and an extending direction E of the post 122 is perpendicular to the axis A, but the disclosure is not limited thereto. In other embodiments, the extending direction of the post may be at an acute angle to the axis A.

The second light guide component 500 is engaged with the fan frame 100, and the light emitted from the light source 300 is configured to be incident on the second light guide component 500. In this embodiment, the second light guide component 500 includes a fourth wall 510 and a plurality of third assembling structures 540. In addition, the second light guide component 500 may further include a fifth wall 520 and a sixth wall 530. The fifth wall 520 and the sixth wall 530 are respectively connected to two opposite sides of the fourth wall 510, and the fifth wall 520 surrounds the sixth wall 530. The fifth wall 520 rests on the outer wall 110*a* of the frame body 110 of the fan frame 100 and is located on the other side of the light source 300. Therefore, the frame body 110, the first light guide component 400 and the second light guide component 500 together surround the light source 300.

The third assembling structures 540 are directly connected to the fourth wall 510 and is located between the fifth wall 520 and the sixth wall 530. Each third assembling structure 540 has a mounting hole 541. The mounting holes 541 of the third assembling structures 540 are respectively engaged with the posts 122 of the first assembling structures 120, such that the third assembling structures 540 are respectively removably mounted on the first assembling structures 120.

In this embodiment, the third assembling structures 540 are located between the fifth wall 520 and the sixth wall 530, but the disclosure is not limited thereto. In other embodiments, the third assembling structures may be connected to the fourth wall 510 via the sixth wall 530.

In other embodiments, the fan may be designed in another way. For example, the fan 10 includes the fan frame 100, the fan rotor 200, the light source 300 and the first light guide component 400. The fan frame 100 forms the accommodation space S1. The fan rotor 200 is located in the accommodation space S1 and is rotatably disposed on the fan frame 100. The light source 300 is disposed on the fan frame 100. The first light guide component 400 is mounted on the fan frame 100 by inserting the posts 122 into the mounting holes 441, and the light emitted from the light source 300 is configured to be incident on the first light guide component 400. The fan rotor 200 is rotatable about an axis A relative to the fan frame 100.

The extending direction E of the post 122 is non-parallel to the axis A. Specifically, the extending direction E of the post 122 is perpendicular to the axis A.

In another embodiment, the fan 10 may further include the second light guide component 500. The second light guide component 500 is mounted on the fan frame 100 by engaging the posts 122 into the mounting hole 541.

According to the fan with light source disclosed by the above embodiments, since the first light guide component and the second light guide component both are mounted on the fan frame via the posts of the first assembling structures, the fan frame can omit the screw hole for the fixation of any light guide component on the fan frame. Therefore, the appearance of the fan frame can be maintained the light leakage can be prevented from occurring and the convenience of the assembling can be maintained.

In addition, the extending directions of the posts are non-parallel or perpendicular to the axis of the fan, such that the appearance of the fan frame is further maintained, the light leakage is further prevented from occurring, and the convenience of the assembling is further maintained.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A fan, comprising:

a fan frame, comprising a frame body and a plurality of first assembling structures, wherein the frame body comprises an outer wall and an inner wall, the outer wall surrounds the inner wall, the inner wall forms an accommodation space, the plurality of first assembling structures each comprise an extending base and a post, in each of the plurality of first assembling structures, the extending base protrudes from the outer wall of the frame body, a part of the extending base is spaced apart from the outer wall of the frame body so that a gap is formed between the part of the extending base and the outer wall of the frame body, and the post protrudes from a side of the extending base that is located away from the outer wall of the frame body;

a fan rotor, located in the accommodation space and rotatably disposed on the fan frame;

at least one light source, disposed on the fan frame; and a first light guide component, engaged with the fan frame, wherein a light emitted from the at least one light source is configured to be incident on the first light guide component;

wherein, the first light guide component comprises a first wall and a plurality of second assembling structures, the plurality of second assembling structures are connected to the first wall and are respectively and removably mounted on the plurality of first assembling structures.

2. The fan according to claim 1, wherein the outer wall has an inner surface and an outer surface, the outer surface of the outer wall faces away from the inner surface of the outer wall, the inner wall has an inner surface and an outer surface, the outer surface of the inner wall faces away from the inner surface of the inner wall and faces toward the inner surface of the outer wall, the inner surface of the inner wall forms the accommodation space, the extending bases of the plurality of first assembling structures protrude from the inner surface of the outer wall of the frame body, and the posts are connected to the outer surface of the inner wall.

3. The fan according to claim 2, wherein the first light guide component further comprises a second wall and a third wall, the second wall and the third wall are respectively connected to two opposite sides of the first wall, the second wall surrounds the third wall, the second wall rests on the outer wall of the frame body of the fan frame and is located on a side of the at least one light source.

4. The fan according to claim 3, wherein the plurality of second assembling structures are located between the second wall and the third wall.

5. The fan according to claim 3, wherein the plurality of second assembling structures are connected to the first wall via the third wall.

6. The fan according to claim 2, wherein the at least one light source comprises a circuit board and a plurality of light emitting components, the circuit board is located in the gap and is fixed between the extending bases and the outer wall of the frame body, the plurality of light emitting components are disposed on a side of the circuit board that is located away from the outer wall of the frame body of the fan frame, the plurality of second assembling structures each have a mounting hole, and the mounting holes of the plurality of second assembling structures are respectively engaged with the posts of the plurality of first assembling structures.

7. The fan according to claim 1, wherein the fan rotor is rotatable about an axis relative to the frame body, extending directions of the posts are non-parallel to the axis.

8. The fan according to claim 7, wherein extending directions of the posts are perpendicular to the axis.

9. The fan according to claim 3, further comprising a second light guide component, wherein the second light guide component is engaged with the fan frame, and the light emitted from the at least one light source is configured to be incident on the second light guide component.

10. The fan according to claim 9, wherein the second light guide component comprises a fourth wall and a plurality of third assembling structures, the plurality of third assembling structures are connected to the fourth wall and are respectively and removably mounted on the plurality of first assembling structures.

11. The fan according to claim 10, wherein the second light guide component further comprises a fifth wall and a sixth wall, the fifth wall and the sixth wall are respectively connected to two opposite sides of the fourth wall, the fifth wall surrounds the sixth wall, the fifth wall rests on the outer wall of the frame body of the fan frame, and the frame body, the first light guide component and the second light guide component together surround the at least one light source.

12. The fan according to claim 2, wherein the fan frame further comprises a plurality of protrusions that are connected to the outer surface of the outer wall.

13. A fan, comprising:

a fan frame, having an accommodation space;

a fan rotor, located in the accommodation space and is rotatably disposed on the fan frame;

at least one light source, disposed on the fan frame; and a first light guide component, mounted on the fan frame via a plurality of posts and a plurality of first mounting holes that respectively mate with each other, and a light emitted from the at least one light source is configured to be incident on the first light guide component;

wherein the fan rotor is rotatable about an axis relative to the fan frame, and extending directions of the plurality of posts are non-parallel to the axis;

wherein the plurality of posts are integrally formed as a single pierce with the fan frame, the plurality of first mounting holes are formed on the first light guide component.

14. The fan according to claim 13, wherein extending directions of the plurality of posts are perpendicular to the axis.

15. The fan according to claim 13, further comprising a plurality of second light guide components, wherein the plurality of second light guide components are mounted on the fan frame via a plurality of second mounting holes and the plurality of posts that respectively mate with each other, the plurality of second mounting holes are formed on the second light guide component.

16. The fan according to claim 13, wherein the fan frame comprises a frame body and a plurality of first assembling structures, the frame body comprises an outer wall and an inner wall, the outer wall has an inner surface and an outer surface, the outer surface of the outer wall faces away from the inner surface of the outer wall, the inner wall has an inner surface and an outer surface, the outer surface of the inner wall faces away from the inner surface of the inner wall and faces toward the inner surface of the outer wall, the inner surface of the inner wall forms the accommodation space, the plurality of first assembling structures each comprise an extending base and one of the posts; in each of the plurality of first assembling structures, the extending base protrudes from the outer wall of the frame body, a part of the extending base is spaced apart from the outer wall of the frame body so that a gap is formed between the part of the extending base and the outer wall of the frame body, the post protrudes from a side of the extending base that is located away from the outer wall of the frame body and is connected to the outer surface of the inner wall; the first light guide component comprises a first wall and a plurality of second assembling structures, the plurality of second assembling structures are connected to the first wall and are respectively and removably mounted on the plurality of first assembling structures.

* * * * *